US009343823B2

(12) United States Patent
Tamm et al.

(10) Patent No.: US 9,343,823 B2
(45) Date of Patent: May 17, 2016

(54) FASTENER FOR A CONNECTOR IN AN ELECTRICAL COUPLING

(71) Applicants: Carl Russel Tamm, Trussville, AL (US); Randy L. Wolf, Trussville, AL (US)

(72) Inventors: Carl Russel Tamm, Trussville, AL (US); Randy L. Wolf, Trussville, AL (US)

(73) Assignee: Classic Connectors, Inc., Clinton, OH (US)

( * ) Notice: Subject to any disclaimer, the term of this patent is extended or adjusted under 35 U.S.C. 154(b) by 36 days.

(21) Appl. No.: 14/514,316

(22) Filed: Oct. 14, 2014

(65) Prior Publication Data

US 2016/0104951 A1 Apr. 14, 2016

(51) Int. Cl.
*H01R 4/38* (2006.01)
*H01R 4/30* (2006.01)

(52) U.S. Cl.
CPC ..... *H01R 4/30* (2013.01)

(58) Field of Classification Search
CPC ..... H01R 4/30; H01R 13/621; H01R 4/305; H01R 4/2408; H01R 4/34; H01R 11/285
See application file for complete search history.

(56) References Cited

U.S. PATENT DOCUMENTS

| | | | | |
|---|---|---|---|---|
| 5,310,365 | A * | 5/1994 | Hashimoto | H01R 11/285 439/756 |
| 7,559,810 | B1 * | 7/2009 | Wu | H01R 4/34 439/709 |
| 8,025,521 | B2 * | 9/2011 | Diniz | H01R 4/2408 439/395 |
| 8,647,159 | B2 * | 2/2014 | Steeves | H01R 4/305 439/798 |
| 9,231,339 | B1 * | 1/2016 | Stier | H01R 13/621 |
| 2014/0110230 | A1 * | 4/2014 | Eberts | H01H 71/08 200/237 |

* cited by examiner

*Primary Examiner* — Jean F Duverne
(74) *Attorney, Agent, or Firm* — The Watson I.P. Group, PLC; Jovan N. Jovanovic; Vladan M. Vasiljevic

(57) ABSTRACT

A fastener for a connector in an electrical coupling including a threaded bolt, a keeper member and a biasing member. The keeper member having a base and a distal member spaced apart from each other and a collapsible portion coupling the base and the distal member to each other in electrical communication. The second end of the threaded bolt extends to the base and is in electrical communication therewith. The distal member has a conductor contact surface. The biasing member includes an inner washer, an outer washer, and a Belleville washer positioned therebetween. The biasing member is insertable between the base and the distal member so that the inner washer is positioned between the base and the Belleville washer and the outer washer is positioned between the Belleville washer and the distal member. The collapsible portion provides an electrical shunt around the biasing member.

16 Claims, 8 Drawing Sheets

FASTENER FOR A CONNECTOR IN AN ELECTRICAL COUPLING

CROSS-REFERENCE TO RELATED APPLICATION

N/A

BACKGROUND OF THE DISCLOSURE

1. Field of the Disclosure

The disclosure relates in general to fasteners, and more particularly, to a fastener for a connector in an electrical coupling. The fastener of the present disclosure is well suited for an application wherein electrical conductivity is of importance along with a relatively high application of torque thereon.

2. Background Art

The use of threaded fasteners for connecting electrical couplings is known in the art. In many instances, it is necessary to attach, for example, splices, supports or other structures onto a conductor. Such conductors include, but are not limited to conductors for electrical transmission and distribution lines.

In many configurations, the use of a threaded fastener acting in compression is employed. Such threaded fasteners are commonly known as setscrews. In many configurations which utilize setscrews, only a portion of the outer strands of a conductor contact the connector structure. A typical set screw contacts a portion of the remainder of the outer strands.

Furthermore, it has been known that certain set screws tend to loosen over time, particularly when employed in electrical connectors. This is due to the thermal cycling nature of electrical loads, resulting in thermal expansion and contraction respectively. To address this, it has been known that the use of a biasing member, employed to maintain the mechanical force applied at the electrical interface between the conductor and the connector, will offset the action of the thermal expansion and contraction. This gives rise to a problem with the setscrew type connector, suitable materials incorporated as the biasing member exhibit a comparatively high electrical resistance. This interferes with the current path through the setscrew itself that could otherwise be relied upon to carry its share of the electrical current from the strands not in direct contact with the connector body.

It is an object of the present disclosure to overcome the deficiencies of the prior art.

SUMMARY OF THE DISCLOSURE

The disclosure is directed in one aspect to a fastener for a connector in an electrical coupling. The fastener includes a threaded bolt, a keeper member and a biasing member. The threaded bolt has a first end and a second end with a threadform extending thereabout. The keeper member includes a base and a distal member spaced apart from each other and coupled together so as to be in electrical communication by way of a collapsible portion. The base has an outer surface, with the second end of the threaded bolt extending to the outer surface and in electrical communication therewith. The distal member has a conductor contact surface. The biasing member includes an inner washer, an outer washer, and a Belleville washer positioned therebetween. The biasing member is insertable between the base and the distal member so that the inner washer is positioned between the base and the Belleville washer and the outer washer is positioned between the Belleville washer and the distal member. The collapsible portion provides an electrical shunt around the biasing member.

In some configurations, the threaded bolt includes a threaded bore extending into the second end region thereof. The base and the distal member of the keeper member each having an opening alignable with the threaded bore and sized so that the second end region extends therethrough, as well as through the inner washer, the outer washer and the Belleville washer. The retaining fastener has a head and a body, the body fastened into the threaded bore of the threaded bolt with the head being larger than the opening of the distal member. The retaining fastener coupling the keeper member, the biasing member and the threaded bolt together in operable engagement.

In some configurations, the distal member includes a screw head retaining cavity structurally configured to receive the head of the retaining fastener.

In some configurations, the threaded bolt and the keeper member comprise an aluminum material, and the inner washer, the outer washer and the Belleville washer comprise a steel, stainless steel, or BeCu material.

In some configurations, the threaded bolt includes an inner tool bore at the first end thereof.

In some configurations, the outer surface of the base of the keeper member includes a mating face configured to receive a stepdown flange, creating a bearing surface of the threaded bolt in abutting engagement.

In some configurations, the conductor contact surface includes an outwardly concave configuration with a substantially uniform cross-sectional configuration, so as to conform to the configuration of a conductor; the conductor contact surface is configured to abut.

In some configurations, the collapsible portion further comprises a first collapsible member and a second collapsible member. The first collapsible member extends from the base to the distal member on a first side of the keeper member. The second collapsible member extends from the base to the distal member on a second side of the keeper member. The first side and the second side are on opposite sides of the keeper member.

In some configurations, the first collapsible member and the second collapsible member are substantially mirror images of each other about an axis that bisects the keeper member.

In some configurations, the base and the distal member are one of rectangular and square configurations. Each has a first side and a second side opposite the first side. The first collapsible member extends from the first side of the base to the first side of the distal member, the second collapsible member extends from the second side of the base to the second side of the distal member.

In some configurations, the first collapsible member includes an outwardly extending bendable portion. The second collapsible member includes an outwardly extending bendable portion.

In some configurations, the keeper member comprises an extruded member.

In another aspect of the disclosure, the disclosure is directed to a fastener for a connector in an electrical coupling. The fastener includes a threaded bolt, a keeper member and a biasing member. The threaded bolt has a first end and a second end with a threadform extending thereabout. The first end thereof including a tool engaging member. The keeper member includes a base and a distal member spaced apart from each other and coupled together so as to be in electrical communication by way of a collapsible portion. The base has an outer surface. The second end of the threaded bolt extends to the outer surface and is in electrical communication therewith. The distal member has a conductor contact surface. The biasing member includes an inner washer, an outer washer, and a Belleville washer positioned therebetween. The biasing member is insertable between the base and the distal member so that the inner washer is positioned between the base and the Belleville washer and the outer washer is positioned between the Belleville washer and the distal member. The collapsible portion provides an electrical shunt around the biasing member. A retaining fastener maintaining the inner washer, outer washer and Belleville washer is in alignment with the keeper member and the threaded bolt.

In another aspect of the disclosure, the disclosure is directed to a fastener for a connector in an electrical coupling comprising a threaded bolt, a keeper member and a biasing member. The threaded bolt has a first end and a second end with a threadform extending thereabout, the first end thereof including tool engaging member. The keeper member includes a base and a distal member spaced apart from each other and coupled together so as to be in electrical communication by way of a collapsible portion. The base has an outer surface, with the second end of the threaded bolt extending to the outer surface and in electrical communication therewith. The distal member has a conductor contact surface. The biasing member includes an inner washer, an outer washer, and a Belleville washer positioned therebetween. The biasing member is insertable between the base and the distal member so that the inner washer is positioned between the base and the Belleville washer and the outer washer is positioned between the Belleville washer and the distal member. The collapsible portion provides an electrical shunt around the biasing member. The second end of the threaded bolt extends through the base of the keeper member and through the inner washer, the outer washer and the Belleville washer toward the distal member.

In some configurations, the fastener includes a retaining fastener coupling the distal member to the second end region of the threaded bolt.

In some configurations, the distal member includes an opening with the head of the retaining fastener engages the opening of the distal member.

In some configurations, the distal member includes a screw head retaining cavity, with the head of the retaining fastener being retained therein.

BRIEF DESCRIPTION OF THE DRAWINGS

The disclosure will now be described with reference to the drawings wherein.

DETAILED DESCRIPTION OF THE DISCLOSURE

Figure 1:
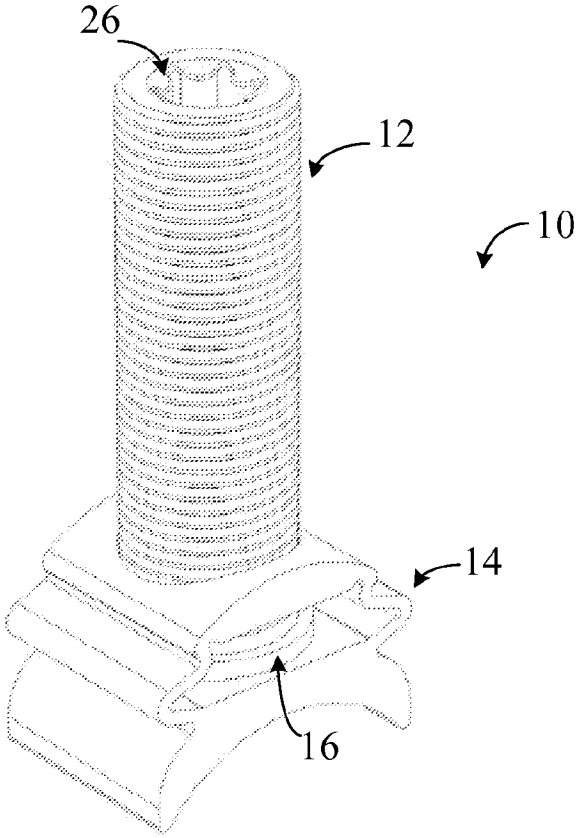
FIG. 1 of the drawings is a perspective view of the fastener of the present disclosure, showing, in particular, the first end of the threaded bolt.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the fastener for a connector in an electrical coupling is shown generally at 10. The connector can be used in any number of electrical couplings, such as, for example, with splicing equipment for distribution and transmission electrical lines. Of course, the fastener is not limited to use therewith and other uses are likewise contemplated. The configuration of the fastener is well suited for the transmission of electrical current therethrough while maintaining appropriate clamping force on a conductor.

The fastener 10 is shown in FIG. 1 in greater detail as including threaded bolt 12, keeper member 14 and biasing member 16. The bolt 12 comprises a threaded bolt that includes first end 20 and second end region 22. The outer surface of the bolt includes threadform 24. The threadform 24 may be uniform or may include surface variations for various purposes. For example, a breakaway threadform is contemplated wherein the bolt 12 is configured to break controllably at a particular point in response to an exerted torque. Of course, a number of different configurations of the same are contemplated. In other embodiments, a substantially uniform threadform is contemplated. The second end region 22 comprises a region of smaller diameter with a step down flange 27 positioned at the interface thereof with the threadform 24. The second end region is configured for insertion through the base member of the keeper and through each of the inner and outer washers and the Belleville washer.

An inner tool bore 26 is disposed at the first end 20. In the configuration shown, the inner tool bore is in the configuration of a hexagon so as to accommodate an Allen wrench or the like of a particular standard size. Of course, other configurations are likewise contemplated such as square, double square, triple square, spline drive, torx configurations, as well as security configurations, among others. In still other configurations an external tool engagement component is contemplated, such as a configuration engageable with a wrench, socket wrench or the like. A threaded bore 28 is positioned at the second end region 22. As will be described below, the threaded bore 28 is configured to accept a retaining fastener 86 of the biasing member 16. It will be understood that in some embodiments, in the place of a bore a second threaded portion of a smaller diameter may extend out of the second end 22 of the threaded bolt and itself may be threaded on the outer surface thereof. A nut or the like may be threaded so as to engage with the screw head retaining cavity.

In the configuration shown, the threaded bolt 12 comprises an aluminum member selected based upon its resistance values and the ability to conduct electricity. Of course, the threaded bolt is not limited to any particular material, and a number of different materials are contemplated.

The keeper member 14 comprises base 30, distal member 32 and collapsible portion 34. The keeper member 14 is preferably formed from a single piece of material. In the configuration shown, the keeper member comprises an extruded aluminum member with post extrusion machining. In other configurations, the keeper member may comprise a cast member, a forged member or a machined member. In the configuration shown, the profile of the keeper member is substantially uniform so as to allow for extrusion formation.

The base 30 includes outer surface 40, inner surface 41, first side 42, second side 44 and opening 46. The outer surface is a generally outwardly convex surface of a substantially continuous curvature extending from the first side 42 to the second side 44, with the transverse cross-sectional configuration being substantially uniform. The outer surface 40 includes a cavity 47 configured to receive the second end 22 of the threaded bolt 12, with the second end of the bolt mating with the mating face 48 within the cavity 47.

The inner surface 41 is generally substantially planar and substantially parallel with the mating face 48 of the cavity 47. The opening extends through the cavity 47 and the mating face 48 of the outer surface through the inner surface. It is contemplated that the opening is substantially perpendicular to the mating face 48 and the inner surface and centrally located on the mating face.

The base 30 is dimensionally larger than the threaded bolt 12 such that the base extends in each direction from the mating face 48 and the cavity 47. In the configuration shown, the inner surface of the base is substantially square in configuration. Although, it is contemplated that variations to the shape are contemplated, such a rectangular configuration, or configurations wherein the sides opposite the first and second side may be other than substantially linear.

The distal member 32 is spaced apart from the keeper member and includes inner surface 50, conductor contact surface 51, first side 52, second side 53, and opening 54. The inner surface 50 is substantially planar and initially substantially parallel to the inner surface 41 of the base 30 and spaced apart therefrom (by way of the collapsible portion 34). The conductor contact surface 51 comprises an outwardly convex arcuate configuration that is intended to extend about a conductor having a substantially round cross-sectional configuration. Along a transverse axis, the conductor contact surface is substantially uniform. The first side 52 corresponds to the first side 42 of the base 30 and the second side 53 corresponds to the second side 44 of the base 30. The length of the base and the distal member is substantially the same. The width of the distal member is wider than the width of the base, in the configuration shown, while such a configuration is not required. In the embodiment shown, the outwardly convex surface of the conductor contact surface defines a pair of opposing wings on the distal member.

An opening 54 extends through the distal member from the first side to the second side thereof. The opening 54 corresponds to the opening 46 in position so that they are along the same axis. Accessible from the conductor contact surface is a screw head retaining cavity 58 which surrounds the opening, and a screw engagement surface 56 at the distal end thereof. The depth of the screw head retaining cavity is such that in use and upon operable tightening about a conductor, the retaining fastener 86 generally remains within the cavity.

The collapsible portion 34 includes first collapsible member 60 and second collapsible member 70. The collapsible members are generally mirror images of each other about an axis that bisects the base and distal member mid-way between the first and second sides thereof. Of course, it will be understood that the first and second collapsible members may have some variations therebetween. The first collapsible portion includes first end 62 that is coupled to the first side 42 and second end 64 coupled to first side 52 of the distal member. Between the first and second ends of the collapsible member, is bendable portion 66. In the configuration shown, the first collapsible member comprises a bellows-like member with a plurality of undulating components. Thus, if the base and the distal member are moved toward or away from each other, the collapsible portion can deform to accommodate the same.

The second collapsible member 70 is substantially identical to the first collapsible member 60. The second collapsible member 70 includes first end 72, second end 74 and bendable portion 76. The first end 72 is coupled to the second side 44 of the base 30. The second end 74 is coupled to the second side 53 of the distal member 32. As with the first collapsible portion, the undulations of the bendable portion 76 allow for the relative movement of the base with the distal member while maintaining a connection to both.

In the embodiment shown, the configurations are mirror images of each other such that a force sufficient to deform the collapsible portions due to the movement of the base and the distal member relative to each other will tend to uniformly deform the first and the second collapsible portions in the same manner. In turn, the relationship between the base and the distal member (the relative parallel configuration of the inner surface 41 of the base 30 and the inner surface 50 of the distal member) is maintained.

In the configuration shown, the collapsible members include a bendable portion that extends outwardly and returns, forming a pair of outward legs that are inclined toward each other with a peak joining the two outward legs. The slope of the legs is such that they extend outwardly a greater distance than in a direction toward or away from the respective base and distal member. Of course, this configuration can be varied without departing from the scope of the disclosure. That is, by altering the thickness of the collapsible members, by adjusting the relative geometry of the same and by altering the cross-sectional configuration of the collapsible portion, as well as other variations can alter the force required to collapse or expand the collapsible portion. Generally, however, the structural function of the collapsible portion is to maintain electrical communication between the base and the distal member. Preferably, the keeper member is formed from an aluminum member which has the desired electrical conductivity. The material comprises a suitable material for exemplary purposes and should not be deemed limiting.

The biasing assembly 16 is shown as comprising inner washer 80, outer washer 82, Belleville washer 84 and retaining fastener 86. The inner washer 80 includes first surface 81, second surface 83, opening 85 and outer edge 87. The washer comprises a steel material, preferably, or other material of sufficient hardness to interact with the Belleville washer 84 such as stainless steel or BeCu, for example. The first surface 81 of the inner washer 80 engages the inner surface 41 of the base 30. It will be understood that multiple inner washers may be presented between the Belleville washer and the base of the keeper member.

The outer washer 82 includes first surface 90, second surface 91, opening 92 and outer edge 93. The outer washer, like the inner washer comprises a steel material, preferably, or other material of sufficient hardness to interact with the Belleville washer 84, such as stainless steel or BeCu. The second surface 91 of the outer washer 82 engages the inner surface 50 of the distal member 32. It will be understood that multiple outer washers may be presented between the Belleville washer and the distal member of the keeper member.

The Belleville washer 84 is shown as comprising first surface 94, second surface 95, inner gripping edge 96 and outer gripping edge 97. As will be understood to those of skill in the art, the Belleville washer 84 comprises a conical configuration. Depending on the spring force that is desired from the Belleville washer, a plurality of stacked Belleville washers may be utilized (arranged in series or in parallel) to achieve the desired spring force. It will be understood that the inner gripping edge 96 is configured to engage one of the inner washer 80, with the outer gripping edge 97 engaging the outer washer 90. While this configuration is preferred, the orientation of the washers could be altered without changing the scope of the disclosure.

The retaining fastener 86 includes head 98 and thread body 99. The retaining fastener 86 extends through the opening 54 of the distal member, and into the threaded bore 28 of the second end of the threaded bolt 12. The configuration of the head is such that that the head engages the opening of the distal member 32. The retaining fastener retains the washers and in the proper orientation for operation, as well as the keeper member to the threaded bolt.

To assemble the fastener, the user is provided with the threaded bolt 12, the keeper member 14 and the biasing assembly 16. In the configuration described, the user first assembles the biasing assembly 16. In particular, the outer washer 82, the inner washer 80 and the Belleville washer 84 are placed in alignment and stacked upon each other. Next, this subassembly is slid between the base and the distal member so that the openings of the washers are axially aligned with the openings of the base and the distal member. The collapsible portion of the keeper member 14 is initially in a configuration that allows for the insertion of the washers therebetween.

Once the washers are properly positioned, the threaded bolt is coupled to the keeper member by inserting the second end region 22 through the opening 46 of the base and through each of the inner washer 80, the Belleville washer 84 and the outer washer 82, reaching and possibly extending into the opening 54 of the distal member. At the end of travel, the stepdown flange 27 seats against the mating face 48 of the outer surface of the base and serves as a bearing surface therebetween.

Once seated, the retaining fastener is directed into the threaded bore 28 of the second end 22 of the threaded bolt 12. The retaining fastener 86 is tightened into the threaded bolt 12. Eventually, the head 98 contacts the screw engagement surface 56 and the head is maintained within the screw head retaining cavity 58. The fastener is now ready for installation. It will be understood that in certain embodiments, a large fastener may extend through the biasing member washers and into the threaded bolt which may extend to the base of the keeper member.

Figure 2:
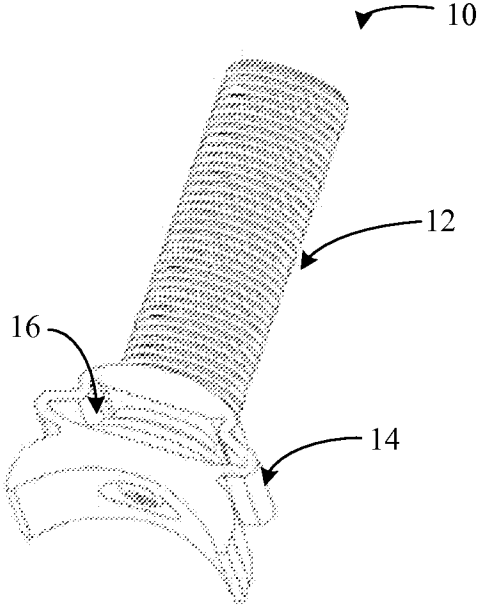
FIG. 2 of the drawings is a perspective view of the fastener of the present disclosure, showing, in particular, the conductor contact surface of the distal member.
Figure 3:
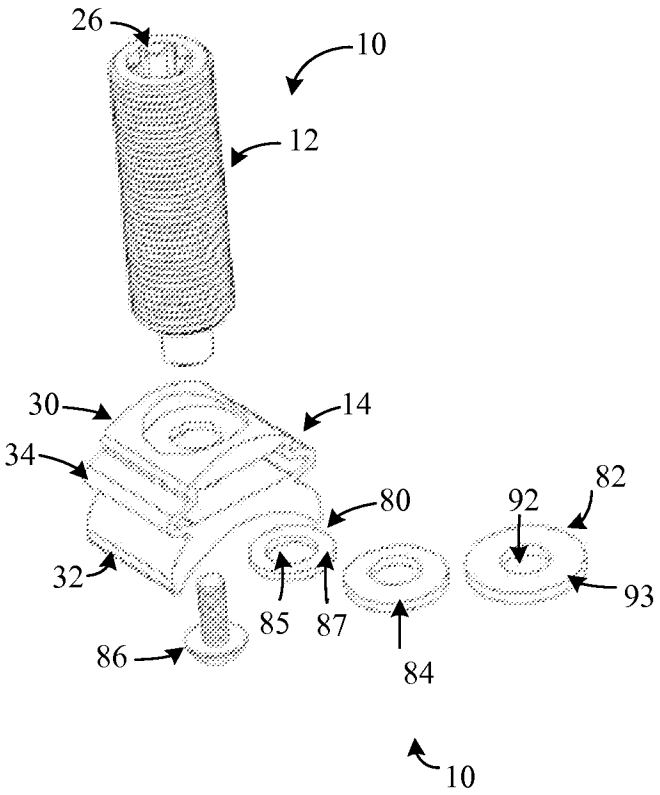
FIG. 3 of the drawings is an exploded view of the fastener of the present disclosure.
Figure 4:
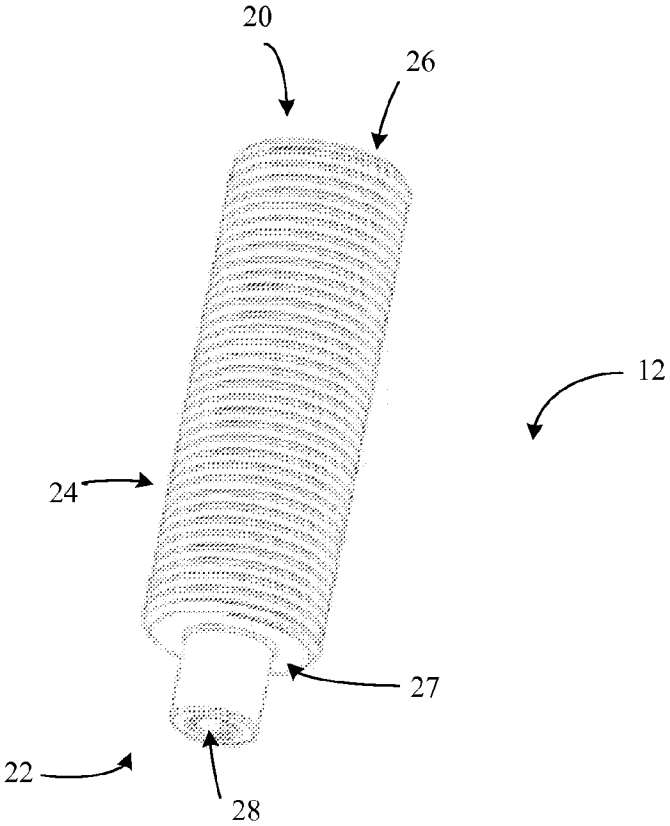
FIG. 4 of the drawings is a perspective view of the threaded bolt of the fastener of the present disclosure.
Figure 6:
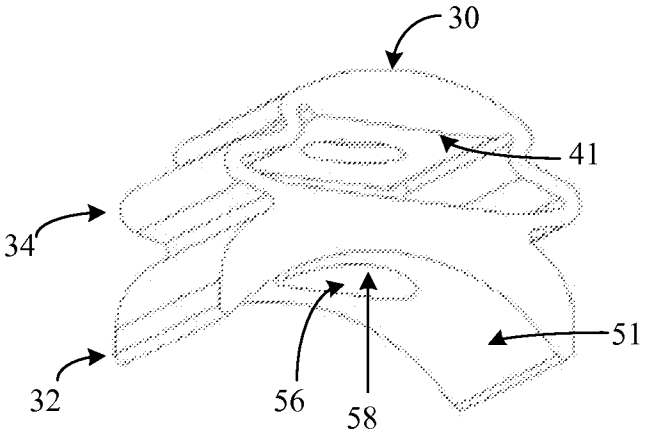
FIG. 6 of the drawings is a perspective view of the keeper member of the fastener of the present disclosure.
Figure 5:
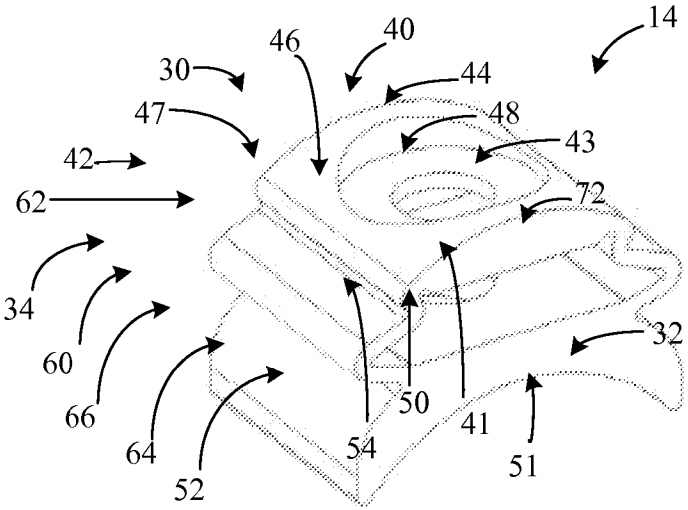
FIG. 5 of the drawings is a perspective view of the keeper member of the fastener of the present disclosure.
Figure 8:
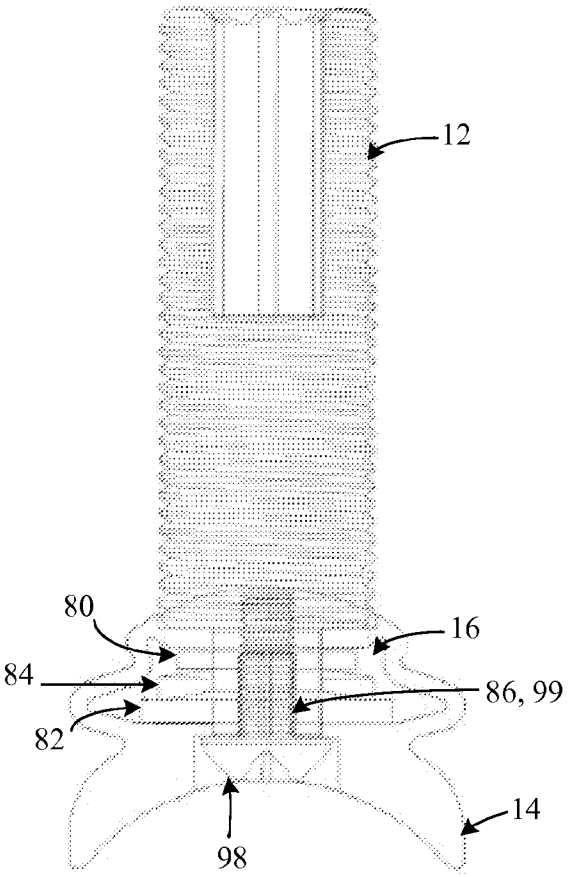
FIG. 8 of the drawings is a cross-sectional view of the fastener of the present disclosure, showing, in particular, the configuration of the biasing member within the keeper member.
Figure 7:
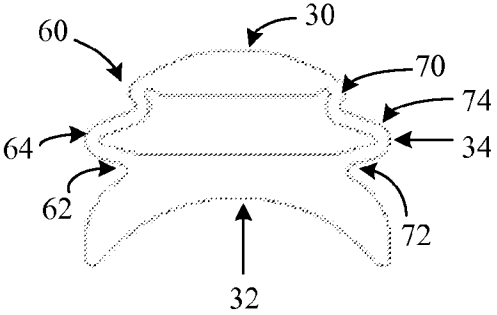
FIG. 7 of the drawings is a side elevational view of the keeper member of the fastener of the present disclosure.
Figure 9:
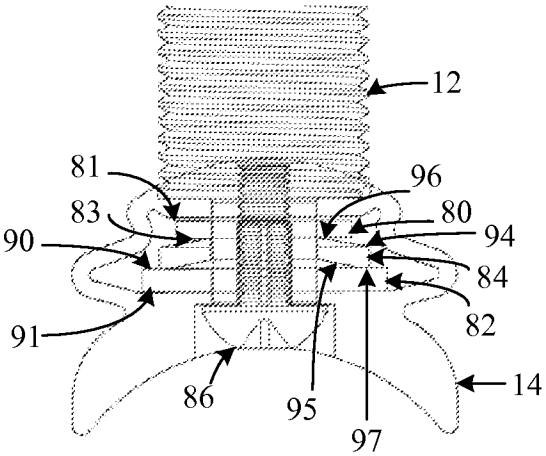
FIG. 9 of the drawings is a partial cross-sectional view of the fastener of the present disclosure, showing, in particular, the configuration of the biasing member within the keeper member.
Figure 10:
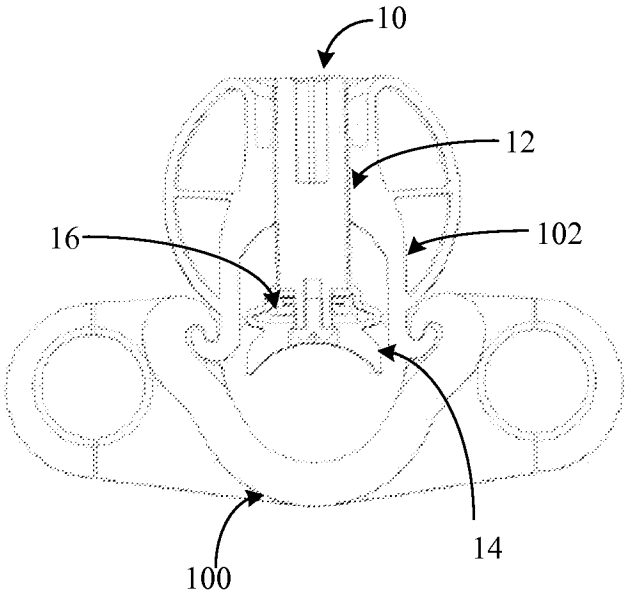
FIG. 10 of the drawings is a cross-sectional view of the fastener of the present disclosure in an operable environment configured for retaining a conductor within a chamber formed by a pair of interconnected chamber portions.

In operation, the fastener is threaded into a threaded opening having a mating threadform. One such configuration is shown in FIG. 2. The threaded fastener is threaded from the inside of the chamber wherein the electrical conductor is placed. In the configuration shown, the chamber is formed from an upper component and a lower component which are slidably coupled together.

Typically, the conductor is positioned in the lower component and the upper component is slidably attached to the lower component. Next, the user can tighten the threaded bolt to advance the threaded bolt into the chamber. Eventually, it will be understood that the conductor contact surface 51 abuts and contacts the conductor. At this time, the electrical pathway through the keeper member to the threaded bolt to the upper component is established. Due to the configuration, the keeper member directs the electrical current through the distal member, the collapsible portion to the base and into the threaded member, wherein, in the preferred embodiment, all of the components are formed from an aluminum or other highly conductive material. That is, the current does not rely on passage from the distal member to the threaded bolt through the biasing member (which is typically a harder material, but also a material of greater electrical resistance). As a result, the keeper member provides an electrical shunt between the conductor and the threaded bolt around the biasing member.

As the threaded bolt is further directed inwardly, the keeper member begins to deform, and in particular, the collapsible portion 34 deforms directing the base 30 toward the distal member 32. This deformation directs a force against the Belleville washer 84, which then becomes loaded. It will be understood that the inner gripping edge and the outer gripping edge of the Belleville washer engages the respective one of the inner and outer washers 80, 82. As the washers are of a harder material, the Belleville washer engages these surfaces during loading. Such placement of the washers on either side of the Belleville washer reduce the possibility of the fastener from loosening due to surface deformation of the surfaces coacting with the Belleville washer.

Once a desired torque is reached, the user can cease tightening the threaded bolt. In certain embodiments, the bolt may break when a predetermined torque is reached or exceeded. It will be understood that in the final configuration the conductor is retained by the force exerted by the fastener against the conductor and the chamber.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A fastener for a connector in an electrical coupling comprising:

a threaded bolt having a first end and a second end with a threadform extending thereabout;

a keeper member including a base and a distal member spaced apart from each other and coupled together so as to be in electrical communication by way of a collapsible portion, the base having an outer surface, with the second end of the threaded bolt extending to the outer surface and in electrical communication therewith, and the distal member having a conductor contact surface; and a biasing member including an inner washer, an outer washer, and a Belleville washer positioned therebetween, the biasing member being insertable between the base and the distal member so that the inner washer is positioned between the base and the Belleville washer and the outer washer is positioned between the Belleville washer and the distal member, wherein the collapsible portion provides an electrical shunt around the biasing member.

2. The fastener of claim 1 wherein: the threaded bolt having a threaded bore extending into the second end region thereof, the base and the distal member of the keeper member each having an opening alignable with the threaded bore and sized so that the second end region extends therethrough, as well as through the inner washer, the outer washer and the Belleville washer and further comprising:

a retaining fastener having a head and a body, the body fastened into the threaded bore of the threaded bolt with the head being larger than the opening of the distal member, the retaining fastener coupling the keeper member, the biasing member and the threaded bolt together in operable engagement.

3. The fastener of claim 2 wherein the distal member includes a screw head retaining cavity structurally configured to receive the head of the retaining fastener.

4. The fastener of claim 2 wherein the threaded bolt and the keeper member comprise an aluminum material, and the inner washer, the outer washer and the Belleville washer comprises one of a steel, stainless steel and a BeCu material.

5. The fastener of claim 1 wherein the threaded bolt includes an inner tool bore at the first end thereof.

6. The fastener of claim 1 wherein the outer surface of the base of the keeper member includes a mating face configured to receive a stepdown flange of the threaded bolt in abutting engagement.

7. The fastener of claim 1 wherein the conductor contact surface includes an outwardly concave configuration with a substantially uniform cross-sectional configuration, so as to conform to the configuration of a conductor the conductor contact surface is configured to abut.

8. The fastener of claim 1 wherein the collapsible portion further comprises:

a first collapsible member extending from the base to the distal member on a first side of the keeper member; and a second collapsible member extending from the base to the distal member on a second side of the keeper member, the first side and the second side being on opposite sides of the keeper member.

9. The fastener of claim 8 wherein the first collapsible member and the second collapsible member are substantially mirror images of each other about an axis that bisects the keeper member.

10. The fastener of claim 9 wherein the base and the distal member are one of rectangular and square configurations, each having a first side and a second side opposite the first side, the first collapsible member extending from the first side of the base to the first side of the distal member, the second collapsible member extending from the second side of the base to the second side of the distal member.

11. The fastener of claim 9 wherein the first collapsible member includes an outwardly extending bendable portion, and the second collapsible member includes an outwardly extending bendable portion.

12. The fastener of claim 1 wherein the keeper member comprises an extruded member.

13. A fastener for a connector in an electrical coupling comprising:

a threaded bolt having a first end and a second end with a threadform extending thereabout, the first end thereof including tool engaging member;

a keeper member including a base and a distal member spaced apart from each other and coupled together so as to be in electrical communication by way of a collapsible portion, the base having an outer surface, with the second end of the threaded bolt extending to the outer surface and in electrical communication therewith, and the distal member having a conductor contact surface; and a biasing member including an inner washer, an outer washer, and a Belleville washer positioned therebetween, the biasing member being insertable between the base and the distal member so that the inner washer is positioned between the base and the Belleville washer and the outer washer is positioned between the Belleville washer and the distal member, wherein the collapsible portion provides an electrical shunt around the biasing member, wherein the second end of the threaded bolt extends through the base of the keeper member and through the inner washer, the outer washer and the Belleville washer toward the distal member.

14. The fastener of claim 13 further comprising a retaining fastener coupling the distal member to the second end region of the threaded bolt.

15. The fastener of claim 13 wherein the distal member includes an opening with the head of the retaining fastener engaging the opening of the distal member.

16. The fastener of claim 13 wherein the distal member includes a screw head retaining cavity, with the head of the retaining fastener being retained therein.

* * * * *